US012320256B2

(12) United States Patent
Ignova

(10) Patent No.: US 12,320,256 B2
(45) Date of Patent: Jun. 3, 2025

(54) STEERING ACTUATION FEEDBACK FOR A ROTARY STEERABLE SYSTEM

(71) Applicant: Schlumberger Technology Corporation, Sugar Land, TX (US)

(72) Inventor: Maja Ignova, Stonehouse (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 208 days.

(21) Appl. No.: 18/048,142

(22) Filed: Oct. 20, 2022

(65) Prior Publication Data

US 2023/0130310 A1 Apr. 27, 2023

Related U.S. Application Data

(60) Provisional application No. 63/262,812, filed on Oct. 21, 2021.

(51) Int. Cl.
*E21B 7/06* (2006.01)
*E21B 44/02* (2006.01)

(52) U.S. Cl.
CPC ..... *E21B 7/068* (2013.01); *E21B 44/02* (2013.01)

(58) Field of Classification Search
CPC .... E21B 17/1014; E21B 47/0228; E21B 7/04; E21B 7/01; E21B 7/068; E21B 7/06
See application file for complete search history.

(56) References Cited

U.S. PATENT DOCUMENTS

| | | | | |
|---|---|---|---|---|
| 8,200,436 | B2 | 6/2012 | Sato et al. | |
| 9,435,649 | B2 | 9/2016 | Sato et al. | |
| 10,439,947 | B2 | 10/2019 | Friel et al. | |
| 2017/0306740 | A1* | 10/2017 | Song | E21B 4/02 |
| 2022/0003043 | A1* | 1/2022 | Nanayakkara | E21B 7/10 |
| 2023/0131473 | A1 | 4/2023 | Trushin et al. | |

* cited by examiner

*Primary Examiner* — Yanick A Akaragwe
(74) *Attorney, Agent, or Firm* — Jeffrey D. Frantz

(57) ABSTRACT

A method for drilling a subterranean wellbore includes rotating a bottom hole assembly (BHA) in the wellbore to drill. The BHA includes a rotary steerable tool or a steerable drill bit having at least one external pad that extends radially outward into contact with a wall of the wellbore and thereby steers while drilling. A toolface demand is received and processed to compute open and close toolface angles for opening and closing a valve that actuates the steering pad. The rotation rate of the BHA is measured and processed to compute times for opening and closing the valve. The valve is opened and closed at the computed times and toolface angles at which the valve opens and closes are measured. The open and close toolface angles are compared with the measured toolface values to obtain a toolface error which is then processed to compute new open and close toolface angles.

15 Claims, 5 Drawing Sheets

STEERING ACTUATION FEEDBACK FOR A ROTARY STEERABLE SYSTEM

CROSS REFERENCE TO RELATED APPLICATIONS

This application claims the benefit of, and priority to, U.S. Patent Application No. 63/262,812, filed Oct. 21, 2021, which application is incorporated herein by this reference in its entirety.

BACKGROUND

The use of rotary steerable systems is well known in downhole drilling operations. Rotary steerable systems are known, for example, to improve rate of penetration of drilling, provide improved hole cleaning owing to the continuous rotation of the drill string, and to provide more accurate well placement at a reduced overall cost as compared to mud motor/bent sub technology.

Numerous commercially available rotary steerable systems make use of hydraulically actuated pads (or blades) to steer. In such systems, the pads may be extended outward from the tool body or retracted inward towards the tool body to actuate and/or adjust the direction of drilling. While such rotary steerable systems are suitable in a wide range of drilling operations, there is room for further improvement. For example, there is a need to improve control of extension and retraction of the hydraulically actuated pads to provide improved wellbore position control, more efficient steering, and better hole quality.

SUMMARY

A method for drilling a subterranean wellbore is disclosed. The method includes rotating a bottom hole assembly (BHA) in the wellbore to drill. The BHA includes a rotary steerable tool or a steerable drill bit having at least one external pad configured to extend radially outward into contact with a wall of the wellbore and thereby steer the drilling. A toolface demand is received and processed to compute open and close toolface angles for opening and closing a valve that actuates the steering pad. The rotation rate of the BHA is measured and processed to compute times for opening and closing the valve. The valve is opened and closed at the computed times and toolface angles at which the valve opens and closes are measured. The open and close toolface angles are compared with the measured toolface values to obtain a toolface error which is then processed to compute new open and close toolface angles.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which:

FIG. 3-1 depicts another example lower BHA portion on which disclosed embodiments may be utilized.

FIG. 3-2 depicts an example steerable drill bit on which disclosed embodiments may be utilized.

FIGS. 4-1 and 4-2 (collectively FIG. 4) depict cross sectional views of one of the pads shown depicted in FIGS. 2, 3-1, and 3-2 in extended (FIG. 4-1) and retracted (FIG. 4-2) positions.

DETAILED DESCRIPTION

Disclosed embodiments relate generally to downhole drilling methods. For instance, some example embodiments relate to methods for actuating steering elements in a rotary steerable system.

Methods for drilling a subterranean wellbore are disclosed and in some embodiments the methods include rotating a BHA in the wellbore to drill. A toolface demand is received and processed to compute open and close toolface angles for opening and closing a valve that actuates a steering pad. The rotation rate of the BHA is measured and processed to compute times for opening and closing the valve. The valve is opened and closed at the computed times and toolface angles at which the valve opens and closes are measured. The open and close toolface angles are compared with the measured toolface values to obtain a toolface error which is then processed to compute new open and close toolface angles. The method may further optionally include making pressure measurements in the pad to obtain a steering impulse (or force). This steering impulse may be compared with a setpoint steering impulse to obtain a steering impulse error which may then be processed with the toolface error to compute the new open and close toolface angles.

The disclosed embodiments may provide various technical advantages and improvements over the prior art. For example, some embodiments may provide for improved steering efficiency as well as for a smoother hole profile and therefore improve overall hole quality. Disclosed embodiments may further provide for improved directional control by better controlling the toolface angles at which steering actuators (pads) extend and retract while drilling.

Figure 1:
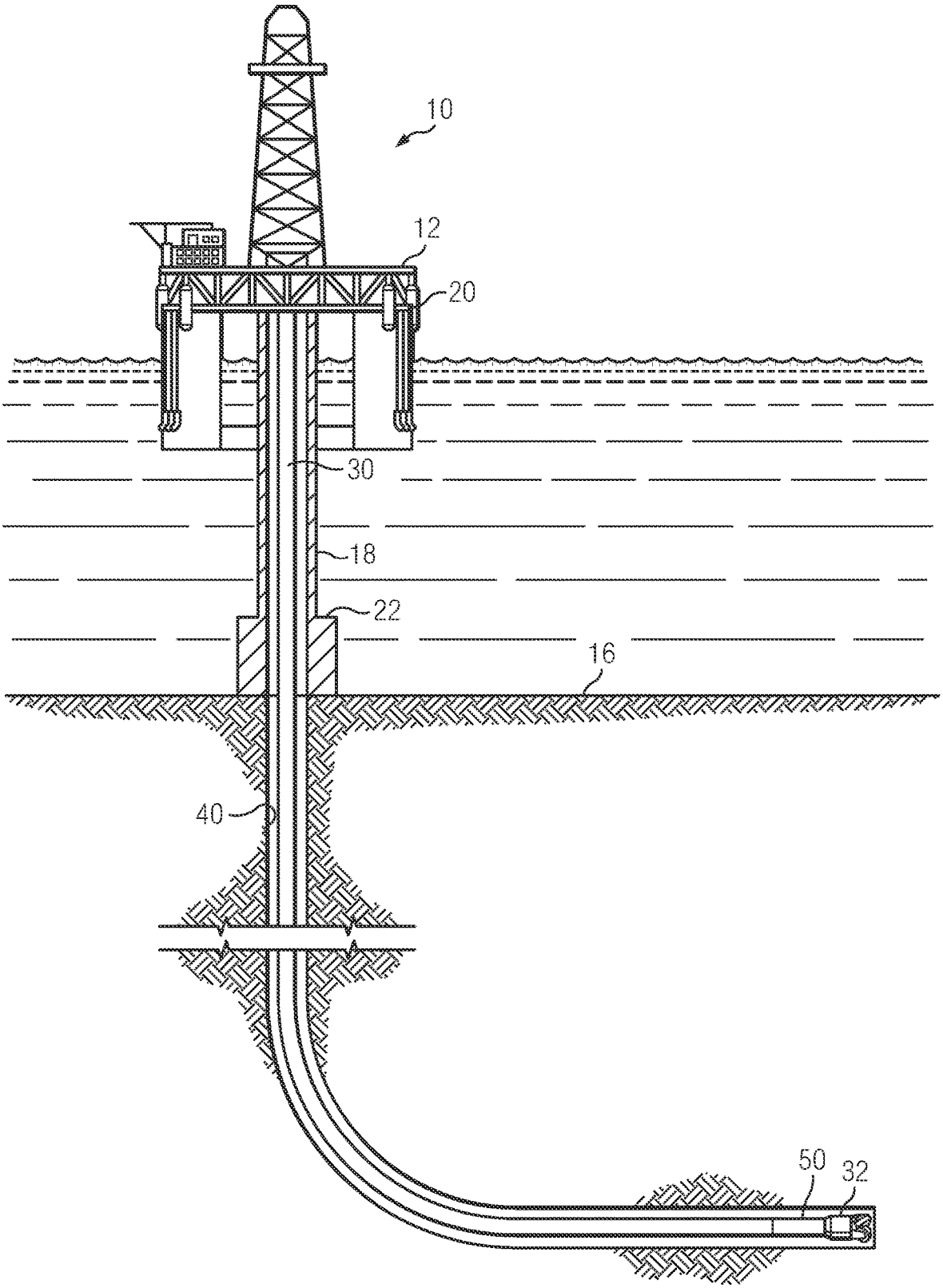
FIG. 1 depicts an example drilling rig on which disclosed embodiments may be utilized.

FIG. 1 depicts a drilling rig 10 suitable for implementing various method embodiments disclosed herein. A semisubmersible drilling platform 12 is positioned over an oil or gas formation disposed below the sea floor 16. A subsea conduit 18 extends from deck 20 of platform 12 to a wellhead installation 22. The platform may include a derrick and a hoisting apparatus for raising and lowering a drill string 30, which, as shown, extends into wellbore 40 and includes a drill bit 32 and a rotary steerable tool 50. Drill string 30 may further include a downhole drilling motor, a downhole telemetry system, and one or more MWD or LWD tools including various sensors for sensing downhole characteristics of the wellbore and the surrounding formation. The disclosed embodiments are not limited in these regards.

It will be understood by those of ordinary skill in the art that the deployment illustrated on FIG. 1 is merely an example. It will be further understood that disclosed embodiments are not limited to use with a semisubmersible platform 12 as illustrated on FIG. 1. The disclosed embodiments are equally well suited for use with any kind of subterranean drilling operation, either offshore or onshore.

With continued reference to FIG. 1, rotary steerable tool 50 may include substantially any suitable rotary steerable tool that makes use of independently actuatable external steering pads. External steering pads are known, for example, in PowerDrive® rotary steerable systems (available from Schlumberger). The PowerDrive® X5, X6, and Orbit rotary steerable systems make use of drilling fluid (mud) actuated pads that contact the wellbore wall. The extension of the pads is rapidly and/or continually adjusted as the system rotates in the wellbore. To drill a desired curvature, a bias phase and neutral phase may be alternated during drilling at a predetermined ratio (referred to as the steering ratio as described in more detail below).

Figure 2:
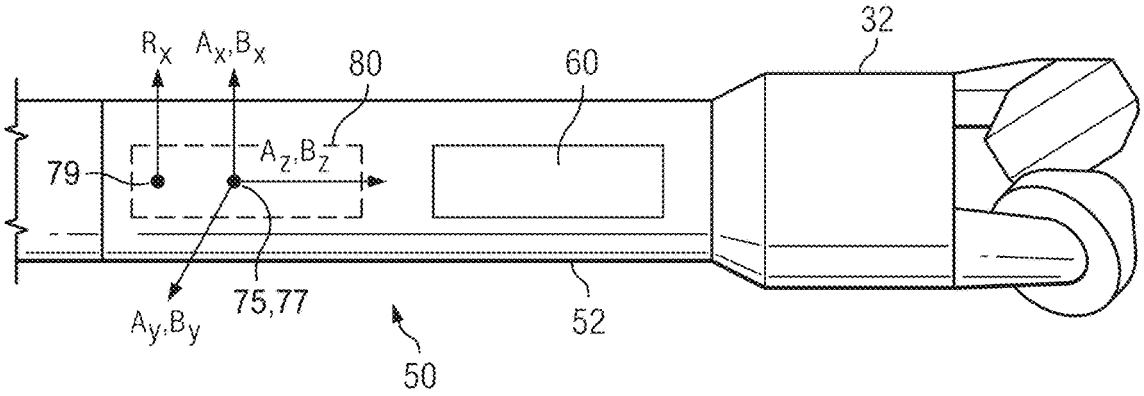
FIG. 2 depicts an example lower BHA portion of the drill string shown on FIG. 1 on which disclosed embodiments may be utilized.

FIG. 2 depicts the lower BHA portion of drill string 30 including drill bit 32 and a suitable rotary steerable tool 50. In the depicted embodiment, rotary steerable tool 50 includes one or more pads 60 deployed in and configured to be extended outward from and retracted inward towards a rotating tool collar 52. A common tool embodiment includes three circumferentially spaced pads deployed at approximately 120 degree intervals about the collar. As described above, the pads may be independently extended outward into contact with the wellbore wall so as to push or point the drill bit 32 in a desired direction (toolface angle) and thereby actuate steering.

While the disclosed embodiments are not limited in this regard, rotary steerable tool 50 may further include navigation (survey) sensors 75, 77, and 79 deployed in a sensor housing 80 (such as a roll-stabilized housing). These sensors 75, 77, and 79 may include, for example, tri-axial accelerometer 75 and tri-axial magnetometer 77 sensor sets and an inertial (gyroscopic) sensor 79. The navigation sensors may include substantially any suitable commercially available devices, for example, including conventional Q-flex type accelerometers or micro-electro-mechanical systems (MEMS) solid-state accelerometers, ring core flux gate magnetometers or magnetoresistive sensors, and MEMS type gyros.

FIG. 2 further depicts a diagrammatic representation of the navigation sensors 75, 77, and 79. By tri-axial it is meant that accelerometer and magnetometer sensor sets each include three mutually perpendicular sensors, the accelerometers being designated as $A_x$, $A_y$, and $A_z$ and the magnetometers being designated as $B_x$, $B_y$, and $B_z$. By convention, a right handed system is designated in which the z-axis accelerometer and magnetometer ($A_z$ and $B_z$) are oriented substantially parallel with the tool axis (and therefore the wellbore axis) as indicated (although disclosed embodiments are not limited by such conventions). In the depicted embodiment gyro 79 is aligned with the x-axis and is designated as $R_x$. Of course, the disclosed embodiments are not limited to those including only a single gyroscopic sensor. Any suitable number of gyroscopic sensors may be employed, for example, including one, two, three, or more (e.g., including a triaxial gyroscopic sensor set). Moreover, the gyroscopic sensor(s) may be deployed on a drive mechanism that rotates the sensor so that it can be aligned with the x- or y-axis of a conventional right handed xyz coordinate system. Suitable gyroscopic sensor embodiments are disclosed in commonly assigned U.S. Pat. Nos. 8,200,436 and 9,435,649.

Figures 1, 3:
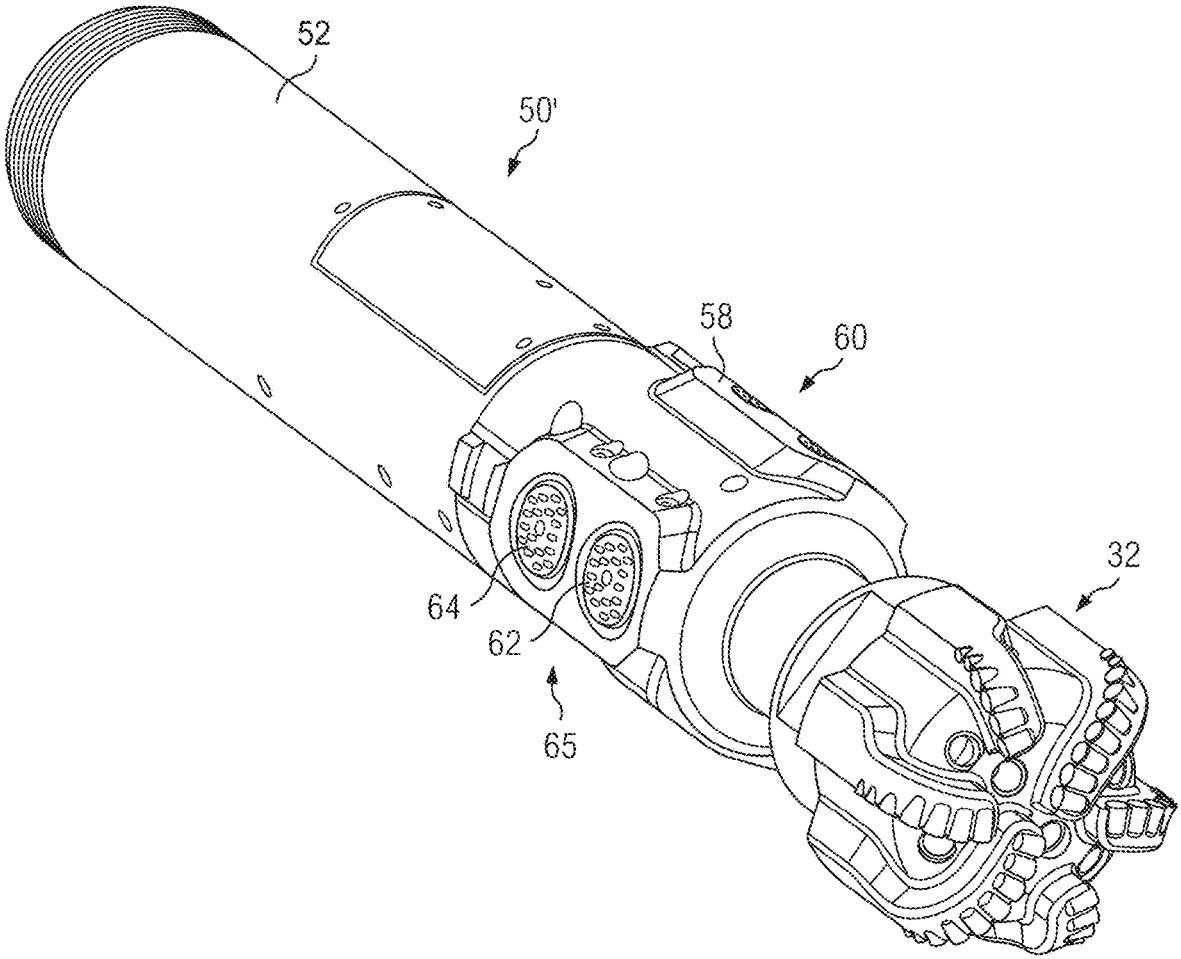
Figures 2, 3:
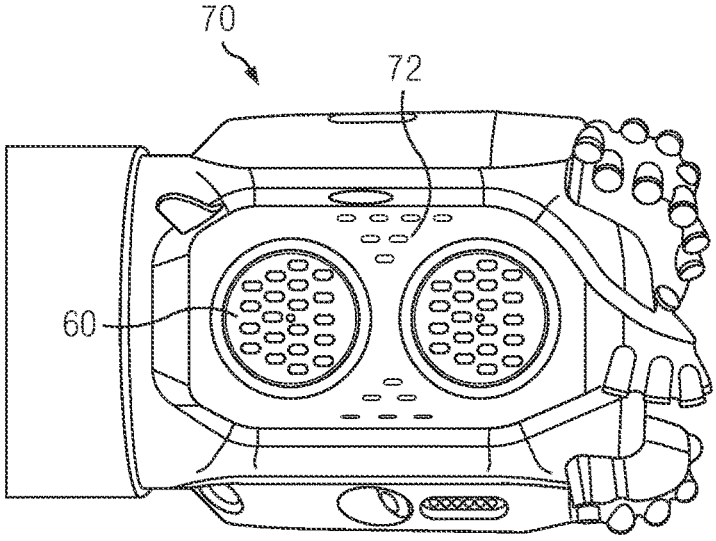

FIG. 3-1 depicts an alternative rotary steerable tool embodiment 50' that includes three circumferentially spaced pad pairs 65 (e.g., spaced at approximately 120 degree intervals about the tool circumference). Each pad pair 65 includes first and second axially spaced pads 62 and 64 deployed in/on a gauge surface 58 of collar 52 configured to rotate with the drill string. Each of the pads 60 is configured to extend outward from the collar 52 into contact with the wellbore wall and thereby actuate steering.

Turning now to FIG. 3-2, it will be understood that the disclosed embodiments are not limited to rotary drilling embodiments in which the drill bit and rotary steerable tool are distinct separable tools (or tool components). FIG. 3-2 depicts a steerable drill bit 70 including a plurality of steering pads 60 deployed in the sidewall of the bit body 72 (e.g., in/on wellbore gauge surfaces). Steerable bit 70 may be thought of as an integral drilling system in which the rotary steerable tool and the drill bit are integrated into a single tool (drill bit) body 72. Drill bit 70 may include substantially any suitable number of pads 60, for example, three pairs of circumferentially spaced pad pairs in which each pad pair includes first and second axially spaced pads as described above with respect to FIG. 3-1. The disclosed embodiments are not limited in this regard.

Based on FIGS. 2, 3-1, and 3-2 it will be understood that the term rotary steerable tool may be descriptive of (and therefore include) a tool that is separable from the drill bit (e.g., as in rotary steerable tools 50 and 50' depicted in FIGS. 2 and 3-1) or a steerable drill bit (e.g., as in steerable bit 70 depicted in FIG. 3-2). The disclosed embodiments are not limited in this regard.

Figures 1, 4:
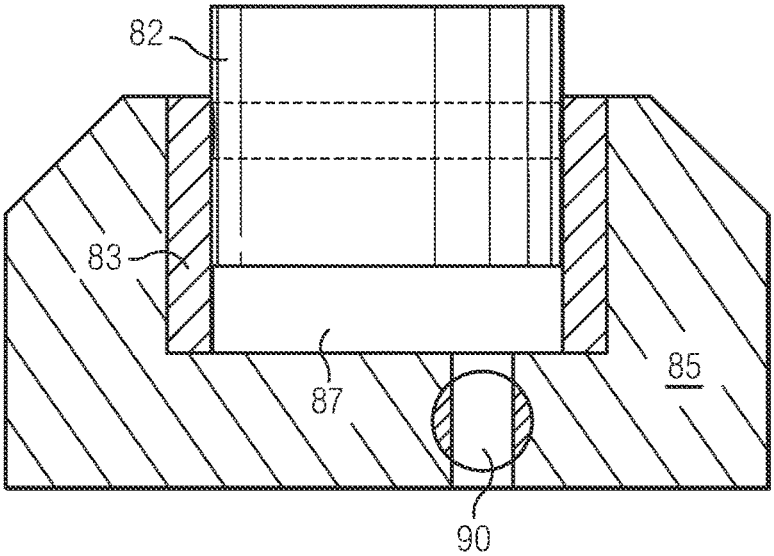
Figures 2, 4:
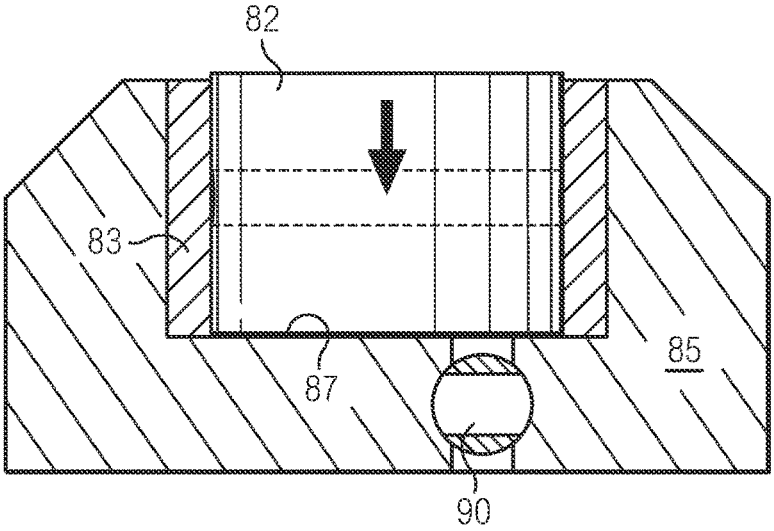

FIGS. 4-1 and 4-2 (collectively FIG. 4) depict cross sectional views of one of the pads 60 shown in extended (FIG. 4-1) and retracted (FIG. 4-2) positions. In the example embodiment shown, a piston 82 is deployed in a corresponding sleeve 83 in pad housing 85. As noted above, the piston 82 is configured to extend outward (as shown on FIG. 4-1) from the housing 85, for example, when valve 90 is open thereby porting drilling fluid through the valve 90 to cavity 87 (which is located radially behind the piston 82 in FIG. 4). The piston 82 may be further configured to retract when valve 90 is closed and drilling fluid is diverted away from the cavity 87 (e.g., via providing a leak path or active exhaust of the fluid in cavity 87 and/or via spring bias). Although not depicted, pad 60 may further include a pressure disposed to measure fluid pressure in the cavity. It will be understood that the disclosed method embodiments are not limited to any particular pad 60 or valve 90 configuration with the exception that the pads (and therefore the valves) may be independently controllable. For example, in a tool including three circumferentially spaced pads, each of the pads is independently controllable via independent opening and closing of at least one corresponding valve. The valves may include "digital" valves such as two-position (open and closed) solenoid valves. Commonly assigned U.S. Pat. No. 10,439,947 is expressly incorporated herein by this reference and discloses various tool and valve embodiments that may be suitable for use with the method embodiments disclosed herein.

As noted above, the direction of drilling may be controlled by actuating the pads 60 (in tools 50, 50', and drill bit 70) with pressurized drilling fluid. The use of rotary valves in such pad actuation is well known. During an active steering mode the pads extend and retract in a predetermined range of toolface angles to cause the drill bit to drill in a predetermined direction. For example, when building (increasing) inclination, each pad may be extended at the low side of the wellbore and retracted at the opposing high side of the wellbore such that the drill bit turns upward (builds inclination). During a neutral mode (or phase) the toolface angle at which the pads extend and retract changes with time as the tool rotates such that drilling tends to proceed straight ahead. In such prior art arrangements, the steering ratio is defined by the ratio of the time in the active mode to the total time (where the time in active mode plus the time in neutral mode equals the total time).

The aforementioned pads 60 may also be independently actuated using digital valves (e.g., solenoid valves). During the active steering mode the pads extend and retract at predetermined toolface angles in a manner similar to that described above for rotary valve embodiments. During the neutral mode, the digital valves remain closed such that the pads are retracted and drilling tends to proceed straight ahead. While these rotary valve and digital valve control methodologies are generally serviceable, there is room for improvement and optimization, for example, to improve the timing and directional control valve/pad actuation to improve steering efficiency and directional control of the drilling operation.

Figure 5:
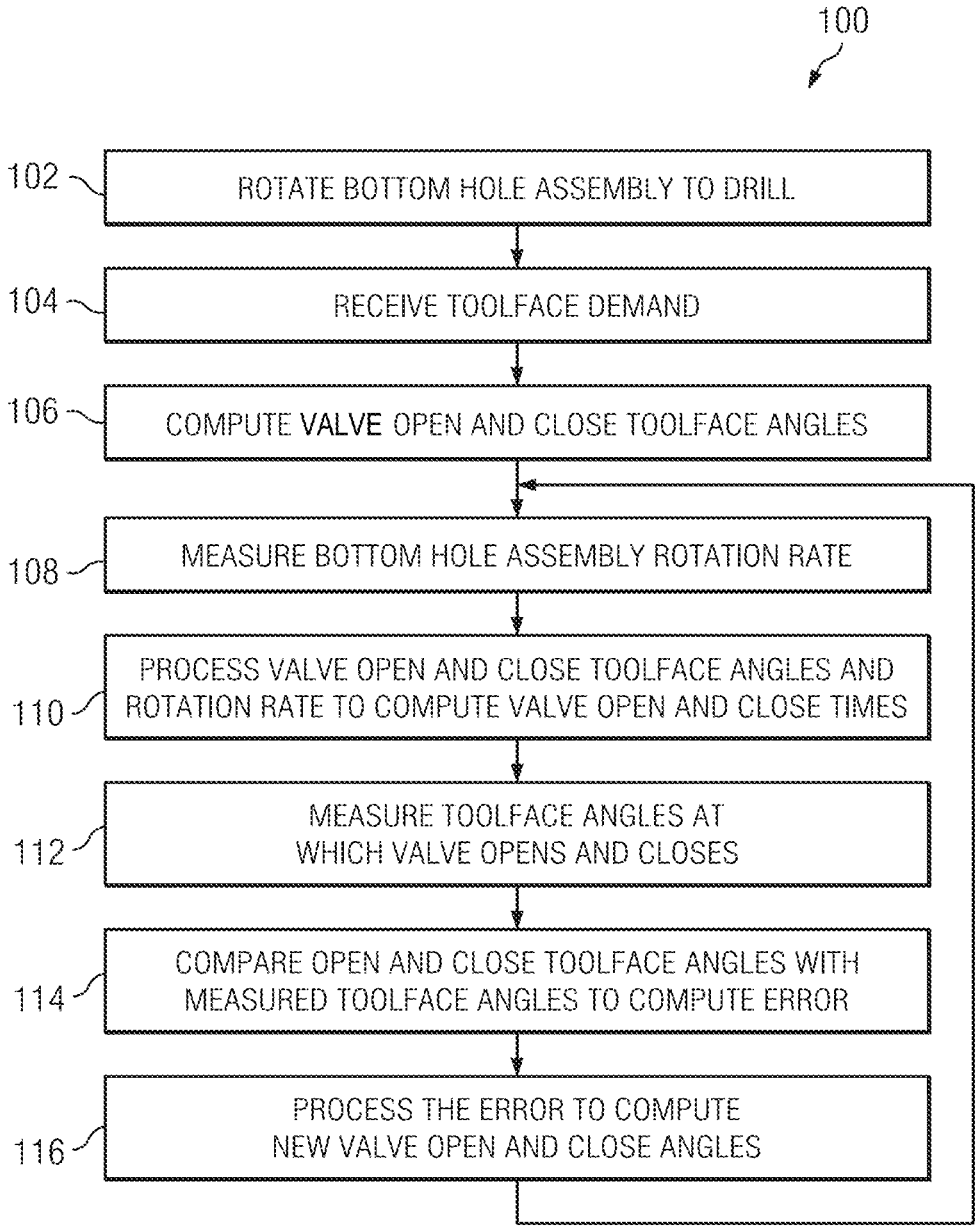
FIG. 5 depicts a flow chart of one example method embodiment for drilling a subterranean wellbore.

FIG. 5 depicts a flow chart of one example method embodiment 100 for drilling a subterranean wellbore. The method includes rotating a bottom hole assembly (BHA) in the subterranean wellbore at 102 to drill the well. The BHA includes at least a drill bit and a rotary steerable tool, for example, including one of the rotary steerable tools 50, 50' or steerable bits 70 described above with respect to FIGS. 1-4. It will be understood that the BHA may be rotated at 102 from the surface (e.g., using a top drive), from a downhole position in the drill string above the steering tool 50, 50' (e.g., using a mud motor), or from both the surface and the downhole position (e.g., as in a power drilling operation). The disclosed embodiments are not limited in this regard.

A toolface demand is received at 104. The toolface demand may be received, for example, from an outer control loop or downlinked from a directional driller at the surface and is generally selected based on a desired drilling direction. For example, the toolface demand may be 180 degrees (i.e., pointing in the downward direction) to build inclination (i.e., to push the bit upwards).

The received toolface demand is processed in 106 to compute open and close toolface angles $TF_{set_o}$ and $TF_{set_c}$ (tool face angles at which the valve(s) is/are to be opened and closed thereby extending and retracting the pad). These open and close toolface angles define a toolface range over which the valve is open (and over which the pad is extended) and are computed so as to steer drilling along the desired direction based on the received toolface demand. In one embodiment, the toolface demand may represent a toolface centerpoint $TF_{set_cp}$ and the open and close toolface angles may be computed from a predetermined toolface range $TF_{set_width}$ that define the toolface range over which the valve is open. For example only, in an embodiment in which $TF_{set_cp}$ is 90 degrees and $TF_{set_width}$ is 120 degrees the open and close toolface angles $TF_{set_o}$ and $TF_{set_c}$ may be computed to be 30 and 150 degrees (90±120/2).

With continued reference to FIG. 5, the rotation rate of the BHA (or drill string) may be measured at 108. The rotation rate may be measured (or computed), for example, using triaxial accelerometer and/or triaxial magnetometer measurements (e.g., via differentiating sequential magnetic or gravity toolface measurements) or via gyroscopic angular velocity measurements. The measurements in 108 may further include toolface measurements. Those of ordinary skill will readily appreciate that gyroscopic and magnetometer measurements generally provide more precise toolface and rotation rate measurements as compared to accelerometer measurements alone.

The open and close toolface angles computed in 106 and the rotation rate measured in 108 are processed in combination at 110 to compute corresponding times $t_{open}$ and $t_{close}$ for opening and closing the valve. As described above, the pad(s) may be independently extended and retracted by opening and closing corresponding digital valves in the tool. Opening the valve connects the rotary steerable pad with pressurized drilling fluid in the steering tool and thereby rapidly extends the pad (e.g., into contact with the wellbore wall). Closing the valve disconnects the pad from the pressurized drilling fluid and enables the pad to be retracted (e.g., via contact with the wellbore wall and venting of the fluid into the annulus).

With continued reference to FIG. 5, the valves may then be opened and closed at the computed times and toolface measurements may be made at 112 to determine the actual toolface values $TF_{meas_o}$ and $TF_{meas_c}$ at which the valve opened and closed. The measured toolface values $TF_{meas_o}$ and $TF_{meas_c}$ are then compared with the open and close toolface angles $TF_{set_o}$ and $TF_{set_c}$ to determine a toolface error at 114. The toolface error may be processed at 116 to compute new open and close toolface angles. It will be understood that method steps 108 through 116 may be repeated substantially any number of times while drilling in 102.

The toolface values may be measured at 112 using substantially any known sensors, for example, including the triaxial accelerometers 75 and magnetometers 77 and/or gyroscopic sensors 79 described above with respect to FIG. 2. For example, magnetic toolface measurements may be made continuously while rotating (e.g., at intervals in a range from about 1 to about 10 milliseconds) to obtain magnetic toolface values as a function of time. These toolface measurements may then be evaluated at the times $t_{open}$ and $t_{close}$ at which the valve was opened and closed (as computed at 110) to obtain the corresponding measured toolface values $TF_{meas_o}$ and $TF_{meas_c}$.

It will be appreciated that the pads may be repeatedly extended and retracted while drilling and steering (via repeatedly opening and closing the corresponding valve). Moreover, the steering tool generally includes three circumferentially spaced pads, each of which is intended to extend and retract at the open and close toolface angles while the tool rotates in 102. As such there may be a large number of valve openings and closings to evaluate. In certain embodiments, it may be advantageous to evaluate multiple valve openings and closings at steps 108, 110, and 112 to compute a mean or median average error.

For example, the open and close toolface angles and the rotation rate may be processed at 110 to compute a plurality of times $t_{open}(i)$ and $t_{close}(i)$ for opening and closing individual ones of the valves within a preselected time window (where i=1, 2 . . . m with m representing the number of pad extensions and retractions in the time window). The time window may include substantially any suitable time interval, for example, counted in time or tool rotations (revolutions). In example embodiments, the time window may be from about 5 to about 50 tool revolutions or from about 1 to about 50 seconds (the disclosed embodiments are of course not limited to these ranges). The toolface measurements may then be evaluated at 114 at the times $t_{open}(i)$ and $t_{close}(i)$ to obtain corresponding measured toolface values $TF_{meas_o}(i)$ and $TF_{meas_c}(i)$. These measured toolface values may be compared with the open and close toolface angles computed in 106 to compute corresponding errors $E_{TF}(i)$. Error statistics may be computed and evaluated at 116 to compute the new open and close toolface angles. These statistics may include substantially any suitable statistics for evaluating the error including a mean error, a median error, a standard deviation of the error, an error distribution, and the like.

It will be further appreciated that the feedback mechanism described above in FIG. 5 is not limited to toolface measurements, but may include other and/or additional measurements such as the fluid pressure in the piston/valve which may be indicative of the force exerted by the pad against the wellbore wall.

Figure 6:
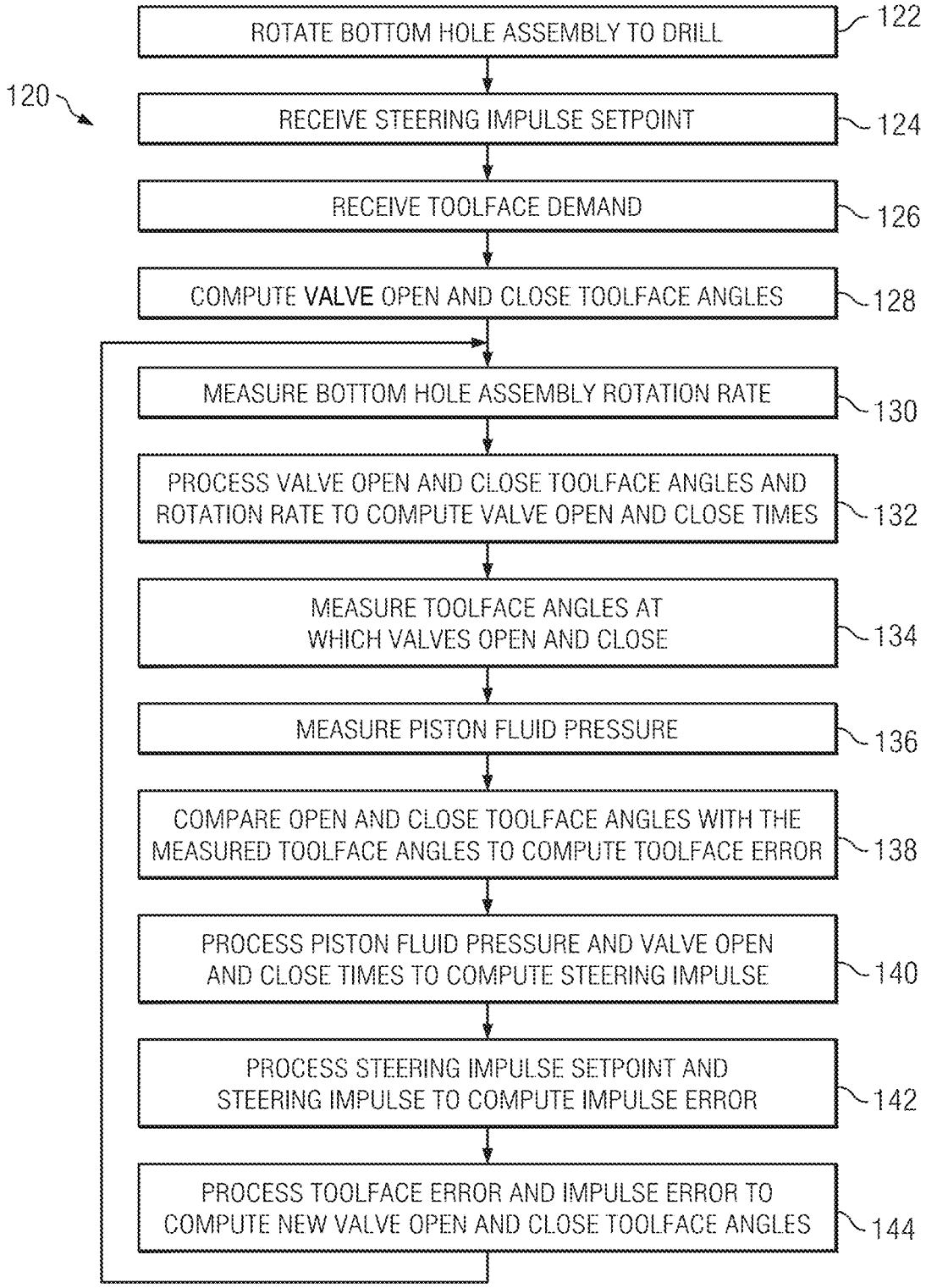
FIG. 6 depicts a flow chart of another example method embodiment for drilling a subterranean wellbore.

FIG. 6 depicts a flow chart of another example method embodiment 120 for drilling a subterranean wellbore that makes use of toolface measurements and fluid pressure measurements. The bottom hole assembly (BHA) is rotated in the subterranean wellbore at 122 to drill the well as described above with respect to FIG. 5. A steering impulse set point $I_{steer_set}$ is received or selected at 124. Those of ordinary skill will readily appreciate that an impulse is the application of a force over a period of time and can be computed by multiplying the force by time. The steering impulse is the force in the pad multiplied by the time that the force is applied. Thought of another way, the steering impulse is the integral of the force with respect to time. At a constant rotation rate the steering impulse may also be thought of as the force in the pad multiplied by the toolface range over which the valve is opened.

A toolface demand is received at 126. The toolface demand may be received, for example, from an outer control loop or downlinked from a directional driller at the surface and is generally selected based on a desired drilling direction (as described above with respect to FIG. 5). While not depicted it will be understood that a measurement time window and or a steering ratio is received or selected at 124 or 126.

The received toolface demand is processed at 128 to compute open and close toolface angles $TF_{set_o}$ and $TF_{set_c}$ (tool face angles at which the valve(s) is/are to be opened and closed thereby extending and retracting the pad), for example, as described above with respect to FIG. 5. As noted above these open and close toolface angles define a toolface range over which the valve is open (and over which the pad is extended) and are computed so as to steer drilling along the desired direction based on receive toolface demand.

With continued reference to FIG. 6, the rotation rate of the BHA (or drill string) may be measured at 130. The open and close toolface angles computed in 128 and the rotation rate measured in 130 may then be processed in combination at 132 (in combination with a selected or preselected measurement time window) to compute a plurality of opening and closing times $t_{open}(i)$ and $t_{close}(i)$ for opening and closing individual ones of the valves. Aspects of these steps are described in more detail above with respect to FIG. 5.

The valves may then be opened and closed at the corresponding times $t_{open}(i)$ and $t_{close}(i)$. Toolface measurements may be made at 134 to determine the actual toolface values $TF_{meas_o}(i)$ and $TF_{meas_c}(i)$ at which the valves open and close. For example, toolface measurements may be made continuously while rotating (e.g., at intervals of about 1 to about 10 milliseconds) to obtain toolface values as a function of time as described above with respect to FIG. 5. The continuous toolface measurements may then be evaluated at 134 at the times $t_{open}(i)$ and $t_{close}(i)$ to obtain the corresponding measured toolface values $TF_{meas_o}(i)$ and $TF_{meas_c}(i)$. These measured toolface values may be compared with the open and close toolface angles at 138 to compute corresponding toolface errors $E_{TF}(i)$. In one example embodiment, $E_{TF}$ may equal an average (or weighted average) of $TF_{set_o}-TF_{meas_o}(i)$ and $TF_{set_c}-TF_{meas_c}(i)$.

Drilling fluid pressure measurements may also be made at 136. For example, the pressure may be measured in piston cavity 87 (FIG. 4) to estimate the extending force of the pad (piston 82) against the wellbore wall (it will be understood that pressure is defined as force divided by area). The force may therefore be estimated by multiplying the pressure by the piston area. The fluid pressure may be measured substantially continuously while rotating to obtain pressure (or force) measurements as a function of time. The continuous pressure measurements may then be evaluated at 140 (e.g., at a time or times between $t_{open}(i)$ and $t_{close}(i)$) to obtain corresponding piston pressures $P_{open}(i)$ (or forces) for each pad extension. The measured pressure and the valve open and close times (defining a total valve open time) may then be processed to compute corresponding steering impulses $I_{steer}(i)$ for each pad extension. The steering impulses may be computed, for example, from the following mathematical equation:

$$I_{steer}(i)=P_{open}(i)\cdot A_{piston}\cdot[t_{close}(i)-t_{open}(i)]$$

where $P_{open}(i)$ represent the piston cavity pressure measurements, $A_{piston}$ represents the area of the pad/piston on which the fluid pressure acts such that $P_{open}(i)\cdot A_{piston}$ represent piston forces, and $t_{close}(i)-t_{open}(i)$ represent the time intervals over which the valve is opened (and the pad is extended). It will be understood that the disclosed embodiments are not limited to the above equation. For example, steering impulses $I_{steer}(i)$ may also be computed as follows:

$$I_{steer}(i)=F_{piston}(i)\cdot[t_{close}(i)-t_{open}(i)]$$

where $F_{piston}(i)$ represent piston forces. These piston forces may be determined via multiplying average forces by a piston area as described above. The forces $F_{piston}(i)$ may alternatively and/or additionally be determined by integrating the above described continuous pressure measurements over the time intervals $t_{close}(i)-t_{open}(i)$. These computed steering impulse values may be compared with the received steering impulse setpoint at 142 to compute corresponding steering impulse errors $E_{SI}(i)$. In one example the steering impulse errors $E_{SI}(i)$ may include ratios of the steering impulse setpoint $I_{steer_set}$ to the measured steering impulses $I_{steer}(i)$.

The toolface errors $E_{TF}(i)$ and the steering impulse errors $E_{SI}(i)$ may be processed individually or in combination at 144 to compute new open and close toolface angles. In one example embodiment, the toolface errors $E_{TF}(i)$ may be processed to compute a new toolface centerpoint $TF_{set_cp}$ and the steering impulse errors $E_{SI}(i)$ may be processed to compute a new width of the toolface range $TF_{set_width}$. For example only, the new open and close toolface angles may be computed according to the following equations:

$$TF_{set_cp}(\text{new})=TF_{set_cp}+\text{Ave}[E_{TF}(i)] \quad \text{EQ. 1}$$

$$TF_{set_width}(\text{new})=\text{Ave}[E_{SI}(i)]\cdot TF_{set_width} \quad \text{EQ. 2}$$

where $TF_{set_cp}$ and $TF_{set_width}$ are related to $TF_{set_o}$ and $TF_{set_c}$, for example, as follows:

$$TF_{set_cp}=(TF_{set_o}+TF_{set_c})/2 \quad \text{EQ. 3}$$

$$TF_{set_width}=TF_{set_c}-TF_{set_o} \quad \text{EQ. 4}$$

and where $$E_{SI}(i)=\frac{I_{steer_set}}{I_{steer}(i)} \quad \text{EQ. 5}$$

As described above with respect to FIG. 5, various error statistics may be computed and evaluated in 144 to compute the new open and close toolface angles. These statistics may include substantially any suitable statistics for evaluating the error including a mean error, a median error, a standard deviation of the error, an error distribution, and the like. It will be understood that method steps 130 through 144 may be repeated substantially any number of times (and for substantially any number of time intervals) while drilling in 122.

It will be appreciated that the disclosed methods may be configured for implementation via one or more controllers deployed downhole (e.g., in a rotary steerable tool such as one of the rotary steerable tools 50 described above with respect to FIGS. 1-4). A suitable controller may include, for example, a programmable processor, such as a digital signal processor or other microprocessor or microcontroller and processor-readable or computer-readable program code embodying logic. A suitable processor may be utilized, for example, to execute the method embodiments (or various steps in the method embodiments) described above with respect to FIGS. 5 and 6. A suitable controller may also optionally include other controllable components, such as sensors (e.g., a temperature sensor), data storage devices, power supplies, timers, and the like. The controller may also be disposed to be in electronic communication with the accelerometers and magnetometers. A suitable controller may also optionally communicate with other instruments in the drill string, such as, for example, telemetry systems that communicate with the surface. A suitable controller may further optionally include volatile or non-volatile memory or a data storage device.

It will be understood that this disclosure may include numerous embodiments. These embodiments include, but are not limited to, the following embodiments.

A first embodiment may comprise a method for drilling a subterranean wellbore. The method includes (a) rotating a bottom hole assembly (BHA) in the subterranean wellbore to drill, the BHA including a rotary steerable tool or a steerable drill bit having at least one external pad configured to extend radially outward into contact with a wall of the wellbore when a corresponding valve is opened and thereby steer the drilling; (b) receiving a toolface demand; (c) processing the toolface demand to compute open and close toolface angles for opening and closing the valve; (d) measuring a rotation rate of said BHA rotation in (a); (e) processing the BHA rotation rate measured in (d) and the open and close toolface angles computed in (c) to compute times for opening and closing the valve; (f) opening and closing the valve at the times computed in (e); (g) measuring toolface angles at which the valve opens and closes in (f); (h) comparing the open and close toolface angles computed in (c) and the toolface angles measured in (g) to compute at least one toolface error; and (i) processing the toolface error to compute new open and close toolface angles.

A second embodiment may include the first embodiment further comprising (i) repeating (d) through (i) while drilling in (a).

A third embodiment may include any one of the first through second embodiments wherein (a) further comprises selecting a steering ratio and selecting a time window for computing the times in (e).

A fourth embodiment may include any one of the first through third embodiments wherein (e) further comprises processing the time window to compute a plurality of times for opening and closing the valve $t_{open}(i)$ and $t_{close}(i)$, wherein i=1, 2, . . . m where m represents a number of pad extensions in the time window.

A fifth embodiment may include any one of the first through fourth embodiments wherein (g) comprises measuring a plurality of toolface angles at which the valve opens and closes in (f) corresponding to the plurality of times for opening and closing the valve computed in (e).

A sixth embodiment may include any one of the first through fifth embodiments wherein (h) comprises computing a plurality of toolface errors corresponding to said measured plurality of toolface angles at which the valve opens and closes.

A seventh embodiment may include any one of the first through sixth embodiments wherein (h) further comprises computing at least one of a mean, a median, a standard deviation, and a distribution of the plurality of toolface errors.

An eighth embodiment may include any one of the first through seventh embodiments wherein the toolface error is computed in (h) by subtracting the measured toolface angles from the open and close toolface angles computed in (c).

A ninth embodiment may include any one of the first through eighth embodiments wherein (b) further comprises receiving a steering impulse setpoint; (g) further comprises measuring a fluid pressure in the pad when the valve is open; (h) further comprises processing the fluid pressure in the pad to compute a steering impulse and comparing the computed steering impulse with the steering impulse setpoint to compute a steering impulse error; and (i) further comprises processing the steering impulse error and the toolface error to compute the new open and close toolface angles.

A tenth embodiment may include the ninth embodiment wherein (i) comprises processing the toolface error to compute a new toolface centerpoint and processing the steering impulse error to compute a new toolface range.

An eleventh embodiment includes a method for drilling a subterranean wellbore. The method comprises (a) rotating a bottom hole assembly (BHA) in the subterranean wellbore to drill, the BHA including a rotary steerable tool or a steerable drill bit having a plurality of external pads configured to extend radially outward into contact with a wall of the wellbore when a corresponding valve is opened and thereby steer the drilling; (b) receiving a toolface demand and a steering impulse setpoint; (c) processing the toolface demand to compute open and close toolface angles for opening and closing the valve; (d) measuring a rotation rate of said BHA rotation in (a); (e) processing a preselected time window, the BHA rotation rate measured in (d), and the open and close toolface angles computed in (c) to compute a plurality of times for opening and closing the valve, $t_{open}(i)$ and $t_{close}(i)$, wherein i=1, 2, . . . m where m represents a number of pad extensions in the time window; (f) opening and closing the valve at the times computed in (e); (g) measuring a plurality of toolface angles at which the valve opens and closes in (f); (h) comparing the plurality of toolface angles measured in (g) and the open and close toolface angles computed (c) and to compute a corresponding plurality of toolface errors; (i) measuring piston fluid pressures when the valve is open in (f); (j) processing the piston fluid pressures with the corresponding times for opening and closing the valve to compute corresponding steering impulses; (k) processing the steering impulses computed in (j) and the steering impulse setpoint received in (b) to compute a corresponding plurality of steering impulse errors; and (l) processing the steering impulse errors and the toolface errors to compute new open and close toolface angles.

A twelfth embodiment includes the eleventh embodiment further comprising (m) repeating (d) through (l) while drilling in (a).

A thirteenth embodiment includes any one of the eleventh through the twelfth embodiments wherein: the toolface errors are computed in (h) by subtracting the measured toolface angles from the open and close toolface angles computed in (c); and the steering impulse errors are computed in (k) by dividing the steering impulse setpoint by the steering impulse measurements.

A fourteenth embodiment includes any one of the eleventh through the thirteenth embodiments wherein (f) further comprises computing at least one of a mean, a median, a standard deviation, and a distribution of each of the plurality of toolface errors and the plurality of steering impulse errors.

A fifteenth embodiment includes any one of the eleventh through the fourteenth embodiments wherein (l) comprises processing the toolface errors to compute a new toolface centerpoint and processing the steering impulse errors to compute a new toolface range.

Although a method for drilling a subterranean wellbore has been described in detail, it should be understood that various changes, substitutions and alterations may be made herein without departing from the spirit and scope of the disclosure. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

What is claimed is:

1. A method for drilling a subterranean wellbore, the method comprising:

(a) rotating a bottom hole assembly (BHA) in the subterranean wellbore to drill, the BHA including a rotary steerable tool or a steerable drill bit having one or more external pads, each configured to extend radially outward when a corresponding valve is opened;

(b) receiving a toolface demand associated with a drilling direction;

(c) determining, based on the toolface demand, open and close toolface angles at which a valve corresponding to an external pad of the one or more external pads is to be opened and closed, respectively, to radially extend and retract the external pad to selectively contact a wall of the wellbore and thereby steer the drilling based on the drilling direction;

(d) determining a time window for opening and closing the valve;

(e) determining a plurality of times in the time window for opening and closing the valve, topen (i) and tclose(i) based on a rotation rate of the BHA and the open and close toolface angles, where i=1, 2, . . . m, where m represents a number of pad extensions in the time window;

(f) opening and closing the valve at the times determined in (e) to radially extend and retract the external pad in the time window to selectively contact the wall of the wellbore and thereby steer the drilling based on the drilling direction;

(g) determining at least one toolface error by comparing actual open and close toolface angles at which the valve opened and closed in the time window with the open and close toolface angles determined in (c);

(h) determining, based on the at least one toolface error, new open and close toolface angles at which the valve is to be opened and closed; and (i) while drilling the wellbore, steering the wellbore drilling in the drilling direction based on the new open and close toolface angles determined in (h).

2. The method of claim 1, further comprising:

(j) repeating (d) through (i) while drilling in (a).

3. The method of claim 1, wherein (a) further comprises selecting a steering ratio for computing the times in (e).

4. The method of claim 1, wherein (g) comprises determining a plurality of toolface errors based on the actual open and close toolface angles at which the valve opened and closed at the plurality of times in the time window.

5. The method of claim 4, wherein (g) further comprises determining at least one of a mean, a median, a standard deviation, or a distribution of the plurality of toolface errors.

6. The method of claim 1, wherein the at least one toolface error is determined in (g) by subtracting measured toolface angles from the open and close toolface angles computed in (c).

7. The method of claim 1, wherein:

(b) further comprises receiving a steering impulse setpoint;

(g) further comprises determining a steering impulse error by comparing a steering impulse associated with the external pad with the steering impulse setpoint; and (h) further comprises determining the new open and close toolface angles based on the steering impulse error.

8. The method of claim 7, wherein (h) comprises determining a toolface centerpoint based on the at least one toolface error, and determining a new toolface range based on the steering impulse error.

9. The method of claim 1, wherein (i) comprises:

determining new times for opening and closing the valve based on the new open and close toolface angles; and opening and closing the valve at the new times to radially extend and retract the external pad to selectively contact the wall of the wellbore.

10. A method for drilling a subterranean wellbore, the method comprising:

(a) rotating a bottom hole assembly (BHA) in the subterranean wellbore to drill, the BHA including a rotary steerable tool or a steerable drill bit having a plurality of external pads, each configured to extend radially outward when a corresponding valve is opened;

(b) receiving a toolface demand associated with a drilling direction and a steering impulse setpoint;

(c) determining, based on the toolface demand, open and close toolface angles at which a valve corresponding to an external pad of the plurality of external pads is to be opened and closed, respectively, to radially extend and retract the external pad to selectively contact a wall of the wellbore and thereby steer the drilling based on the drilling direction;

(d) determining a plurality of times in a preselected time window for opening and closing the valve, topen(i) and tclose(i), based on a rotation rate of the BHA and the open and close toolface angles, wherein i=1, 2, . . . m where m represents a number of pad extensions in the time window;

(e) opening and closing the valve at the times determined in (d) to radially extend and retract the external pad in the time window to selectively contact the wall of the wellbore and thereby steer the drilling based on the drilling direction;

(f) determining a plurality of toolface errors by comparing actual open and close toolface angles at which the valve opened and closed with the open and close toolface angles determined in (c);

(g) determining a plurality of steering impulse errors by comparing the steering impulse setpoint with the actual steering impulses associated with opening and closing the valve;

(h) determining new open and close toolface angles at which the valve is to be opened and closed based on the plurality of toolface errors and the plurality of steering impulse errors; and (i) while drilling the wellbore, steering the wellbore drilling in the drilling direction based on the new open and close toolface angles determined in (h).

11. The method of claim 10, further comprising:

(j) repeating (d) through (i) while drilling in (a).

12. The method of claim 10, wherein:

the toolface errors are determined in (f) by subtracting measured toolface angles from the open and close toolface angles computed in (c); and the steering impulse errors are determined in (g) by dividing the steering impulse setpoint by steering impulse measurements.

13. The method of claim 10, wherein (g) further comprises computing at least one of a mean, a median, a standard deviation, and a distribution of each of the plurality of toolface errors and the plurality of steering impulse errors.

14. The method of claim 10, wherein (i) comprises processing the toolface errors to compute a new toolface centerpoint and processing the steering impulse errors to compute a new toolface range.

15. The method of claim 10, wherein (i) comprises:

determining new times for opening and closing the valve based on the new open and close toolface angles; and opening and closing the valve at the new times to radially extend and retract the external pad to selectively contact the wall of the wellbore.

* * * * *